US012012819B2

(12) United States Patent
Marbach et al.

(10) Patent No.: US 12,012,819 B2
(45) Date of Patent: Jun. 18, 2024

(54) WELLHEAD ELECTRICAL FEED-THRU PENETRATOR SEALING, BREAKAWAY APPARATUS AND METHOD OF INSTALLATION

(71) Applicant: POWER FEED-THRU SYSTEMS AND CONNECTORS LLC, Deer Park, TX (US)

(72) Inventors: Brandon Marbach, Spring, TX (US); Roy Kinkaid, Baytown, TX (US); James Patrick Payne, League, TX (US); Albert George Ollre, V, Houston, TX (US)

(73) Assignee: POWER FEED-THRU SYSTEMS AND CONNECTORS LLC, Deer Park, TX (US)

( * ) Notice: Subject to any disclaimer, the term of this patent is extended or adjusted under 35 U.S.C. 154(b) by 191 days.

(21) Appl. No.: 17/745,536

(22) Filed: May 16, 2022

(65) Prior Publication Data

US 2023/0265731 A1 Aug. 24, 2023

Related U.S. Application Data

(63) Continuation-in-part of application No. 17/652,379, filed on Feb. 24, 2022.

(51) Int. Cl.

| | |
|---|---|
| ***E21B 33/04*** | (2006.01) |
| ***E21B 17/02*** | (2006.01) |
| ***E21B 33/038*** | (2006.01) |

(52) U.S. Cl.
CPC ..... *E21B 33/0407* (2013.01); *E21B 17/028* (2013.01); *E21B 33/0385* (2013.01)

(58) Field of Classification Search
CPC . E21B 17/028; E21B 33/0407; E21B 33/0385
See application file for complete search history.

(56) References Cited

U.S. PATENT DOCUMENTS

| | | | | |
|---|---|---|---|---|
| 6,688,386 | B2 * | 2/2004 | Cornelssen | E21B 33/0407 166/97.5 |
| 10,280,701 | B2 * | 5/2019 | Emerson | E21B 33/0355 |
| 10,760,350 | B2 * | 9/2020 | Anderson | E21B 43/128 |
| 10,871,040 | B2 * | 12/2020 | Ames | E21B 17/0285 |
| 11,070,043 | B1 * | 7/2021 | Marbach | H02G 15/115 |
| 2022/0106840 | A1 * | 4/2022 | Firth | E21B 33/068 |

* cited by examiner

*Primary Examiner* — Nicole Coy
(74) *Attorney, Agent, or Firm* — Alexander B. Uber; Gray Reed

(57) ABSTRACT

An improved wellhead electrical connection assembly utilizing upper and lower retention mechanisms to minimize pressure and fluid leakage in the event of a tubing part or other failure. The upper retention mechanism ensures the connection assembly remains within a tubing hanger. The lower retention mechanism provides a secure connection to a downhole cable that can breakaway without damaging or dislodging other components of the assembly during an emergency event.

9 Claims, 23 Drawing Sheets

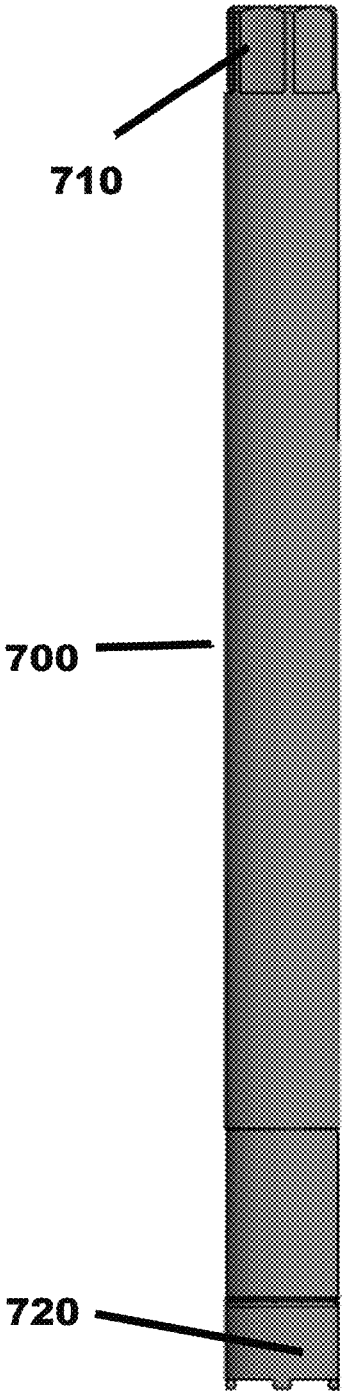
FIG 15A
FIG 15B
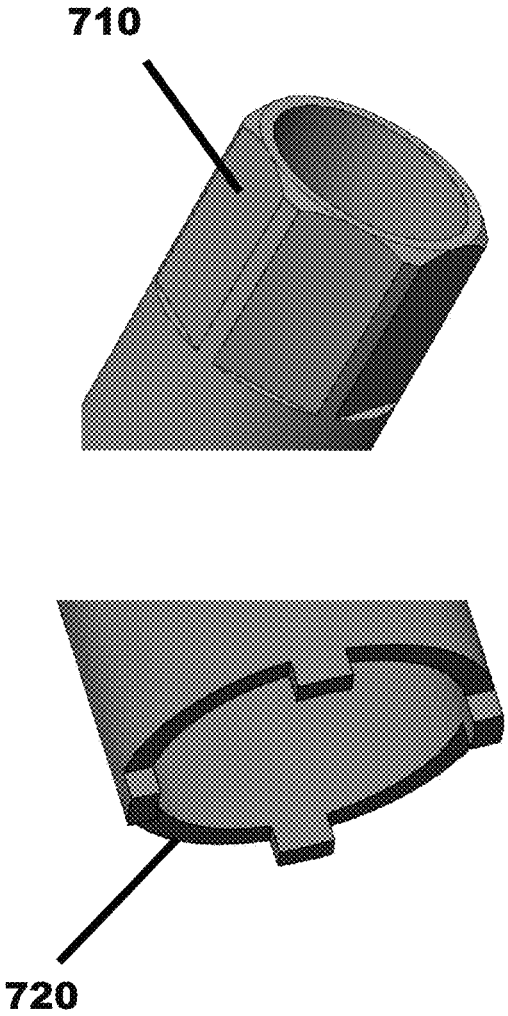
FIG 15C

WELLHEAD ELECTRICAL FEED-THRU PENETRATOR SEALING, BREAKAWAY APPARATUS AND METHOD OF INSTALLATION

CITATION TO PRIOR APPLICATIONS

The present application is a Continuation-In-Part of and claims priority to U.S. Nonprovisional application Ser. No. 17/652,379, titled "WELLHEAD ELECTRICAL FEED-THRU PENETRATOR WITH SEALING, BREAKAWAY APPARATUS AND METHOD OF INSTALLATION" and filed on or about Feb. 24, 2022.

BACKGROUND AND SUMMARY

Wellhead penetrators are purposed to allow electrical power to be delivered down a well from a surface source. As a result, wellhead penetrators play an integral role in many wellhead operations. Consistent with other wellhead components and structures, a wellhead penetrator can sometimes become exposed to the high-pressure environment that arises within a producing well. Accordingly, conventional wellhead penetrators attempt to incorporate design elements directed at safely responding to such pressures in the event of some downhole failure or other emergency scenario. These conventional safeguards, however, often allow high pressure to extend up through to the wellhead and can come at the cost of other wellhead components that may become lost or otherwise destroyed during a break in some tubing connection.

For example, in some conventional designs, a wellhead penetrator assembly permits a cable from an electric submersible pump (ESP) to pass through the wellhead. In the event of a downhole failure, wellbore fluids could migrate through the wellhead ultimately reaching the outer barrier that facilitated the connection between the ESP cable and apparatus external to the wellhead. This is an undesirable situation as the well would require substantial workover activities, and the pressurized wellbore fluids would need to be safely handled to avoid injury and/or environmental exposure to harmful fluids. The only practical method to minimize the potential effects of the pressurized cavity and environmental damage would be to "kill" the well with kill fluids that would balance out the pressure differential. It is an object of the present disclosure to avoid this situation. Rather than having an ESP cable pass through the wellhead, the ESP connection terminates in the tubing hanger. This approach eliminates the need for a separable connection outside the wellhead and any gas buildup would occur lower within the well.

In other conventional designs, a power cable originating from the surface and passed through the wellhead will extend alongside the production tubing and connect to an ESP (or other, similar technology) that is itself connected to the bottom end of a tubing string. Wellhead penetrator assemblies of this design often focus on the seal made against the surface-originating power cable as it is passed through the wellhead. During a tubing part or other failure, shifting downhole components may put the ESP cable in tension and apply thousands of pounds of force along the connection. As with the previously discussed convention design, this is an undesirable situation as such force may disrupt the seal made against the surface-originating power cable and could ultimately allow wellbore fluids to reach the outer atmosphere. It is also an object of the present disclosure to avoid this scenario.

A penetrator assembly in accordance with the present disclosure creates an improved sealed connection between a surface-originating power cable and an ESP (or other similar technology) cable by providing a secure retention mechanism that allows for the downhole portion of the connection to disengage with the assembly during a tubing part or other failure. Even during such a failure, the presently disclosed penetrator assembly maintains its seal integrity thereby preventing pressure buildup in the wellhead as well as the exposure of any wellbore fluids to the outer atmosphere.

BRIEF DESCRIPTION OF THE DRAWINGS

FIGS. 15A-C depicts side, perspective first end, and perspective second end views of an actuation tool in accordance with various embodiments of the present disclosure.

DETAILED DESCRIPTION

This description, with references to the figures, presents non-limiting examples of embodiments of the present disclosure.

Embodiments of this disclosure relate generally to an improved wellhead electrical connection assembly that may be used, for example, in oil and gas operations. Some embodiments of such an improved wellhead electrical connection assembly include a penetrator assembly.

Figure 1:
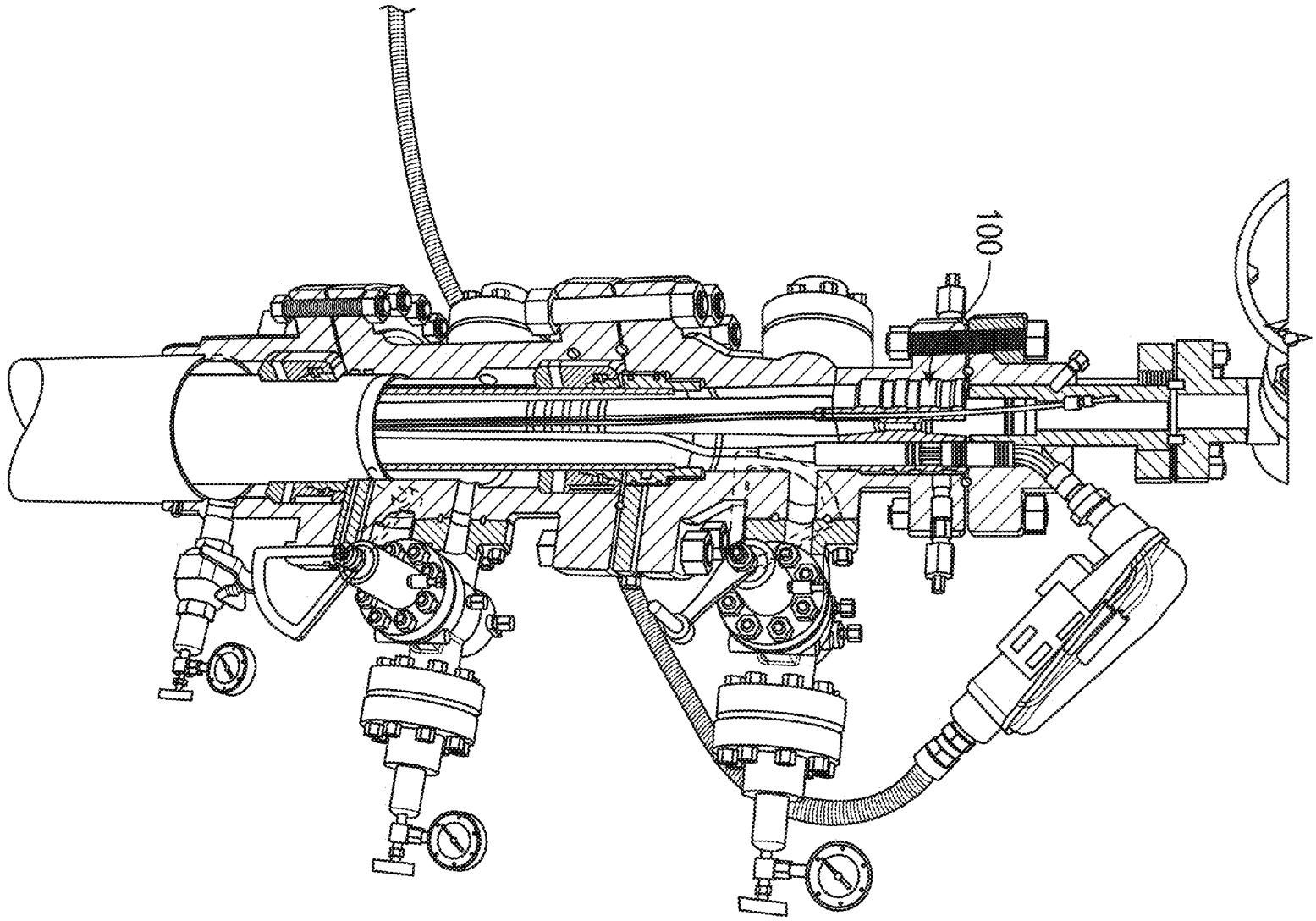
FIG. 1 (Prior Art)
FIG. 1 depicts a cutaway, perspective view of conventional wellhead assembly including a tubing hanger.
Figure 2A:
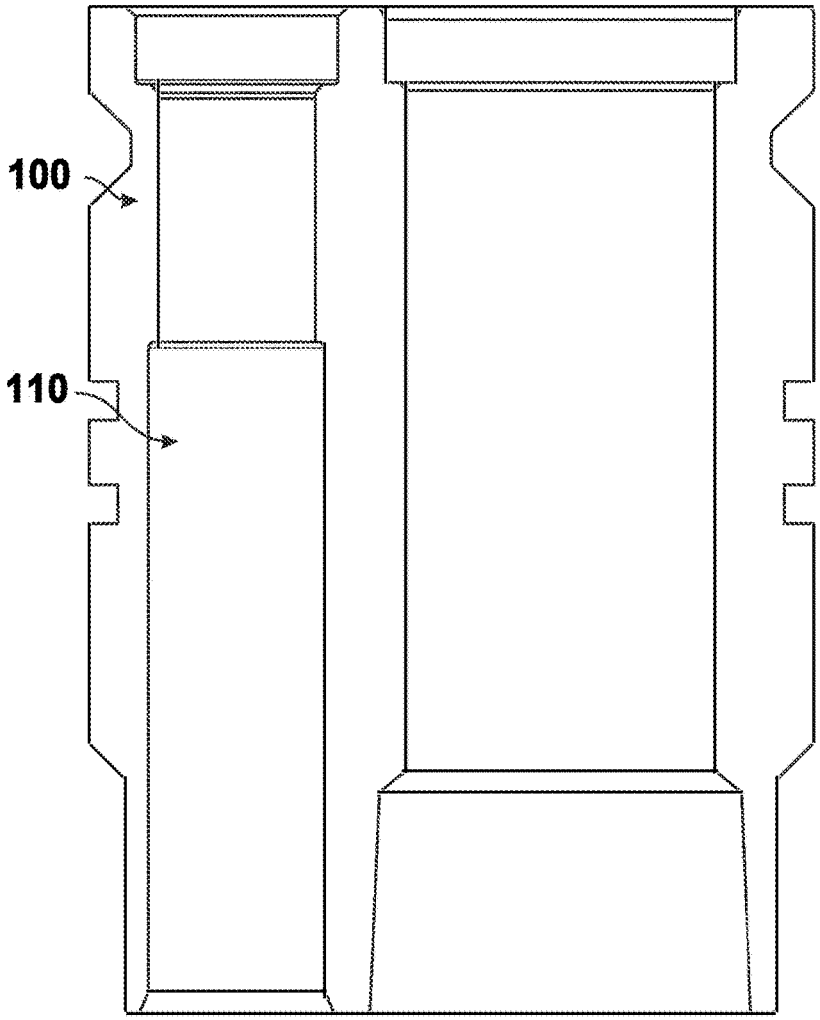
FIGS. 2A-B depict a cutaway view of a conventional tubing hanger with a penetrator assembly profile and a side view of an ESP cable that has been prepared to engage with a penetrator assembly.
Figure 2B:
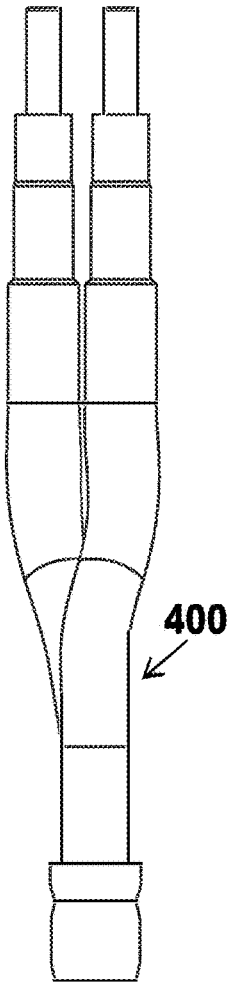
Figure 3:
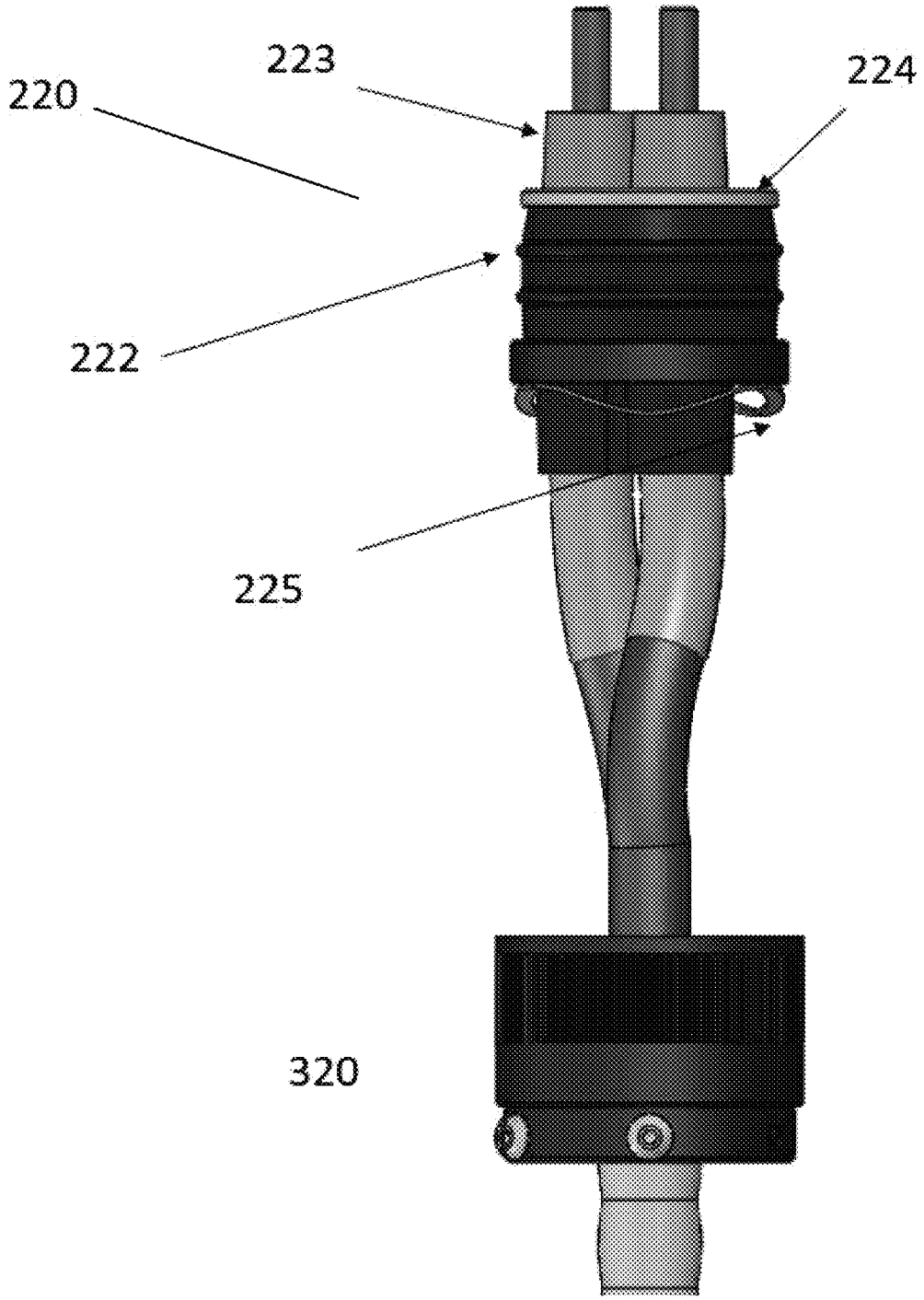
FIG. 3 depicts a side view of an ESP cable prepared in accordance with various embodiments of the present disclosure.

As shown in FIG. 1, conventional approaches often utilize a tubing hanger 100 having a penetrator assembly disposed therein. These penetrator assemblies are used to facilitate a connection between an external power source and downhole apparatus, such as ESPs. Tubing hangers are often configured to receive a penetrator assembly in a designated volume 110 within the tubing hanger as seen in FIG. 2.

In certain embodiments of the present disclosure, as illustrated in FIGS. 3-7, penetrator assembly 200 may have an upper assembly 210 and a lower assembly 220. Upper assembly 210 may include an upper body 211 and at least one conductor receiver 212. Upper body 211 may be substantially formed of polyetheretherketone (PEEK) or other suitable insulating material. Upper body 211 may be configured with a first upper groove on an upper body exterior face to receive a first outer sealing element 217. First outer sealing element 217 may be an elastomeric O-ring. First outer sealing element 217 is configured to minimize any potential fluid flow beyond its position on the exterior surface of upper body 211. Each of the at least one conductor receiver 212 may include a conductor retention element 213. Each of the at least one conductor receiver 212 may be a copper lug. Each of the at least one conductor receiver 212 may be configured with a first female end and a second female end positioned opposite one another wherein the first and second female end are each configured to receive a conductor. Conductor retention element 213 may be at least one set screw which may be tightened to securely retain any conductor that is received within the conductor receiver 212. Set screws may be flat-faced for improved performance. Those of ordinary skill in the art would appreciate that alternative retention elements, such as a simple plug/socket design, would provide for a similar retention and release mechanism (though at a substantially lower tensile force). Upper assembly 210 may be configured to receive at least one external power cable 214. At least one nose sealing element 215 may also be included in upper assembly 210. A small amount of dielectric grease may be applied to each of at least one nose sealing element 215 to allow each of at least one nose sealing element 215 to slide down each of at least one external power cable 214 and into upper body 211 until each of at least one nose sealing element 215 is substantially flush with an upper face 216 of upper body 211. Lower assembly 220 may include a primary lower sealing element 222, at least one secondary lower sealing element 223, and a follower 224. Follower 224 may be substantially formed of PEEK or other suitable insulating material. Lower assembly 220 is configured to be installed at least one ESP cable 400. Each conductor of each of at least one ESP cable 400 may be passed through primary lower sealing element 222. Each conductor of each of at least one ESP cable 400 may pass through one of said at least one secondary lower sealing element 223. Follower 224 may be passed over at least one secondary lower sealing element 223. Lower assembly 220 may further include a spring element 225. Spring element 225 may be a wave spring.

Figure 4:
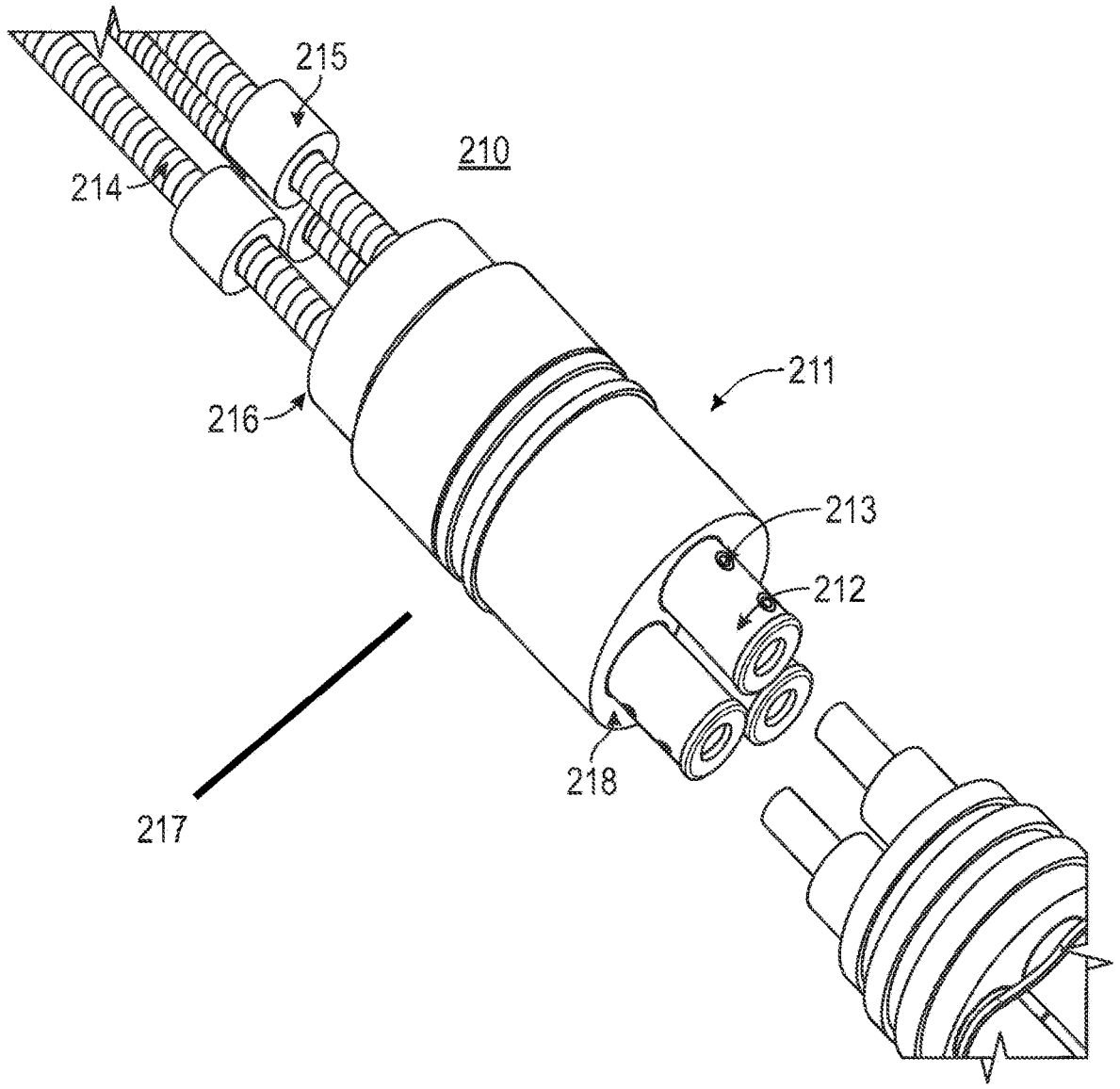
FIG. 4 depicts a perspective view of an upper penetrator assembly and a lower penetrator assembly in accordance with various embodiments of the present disclosure.
Figure 5:
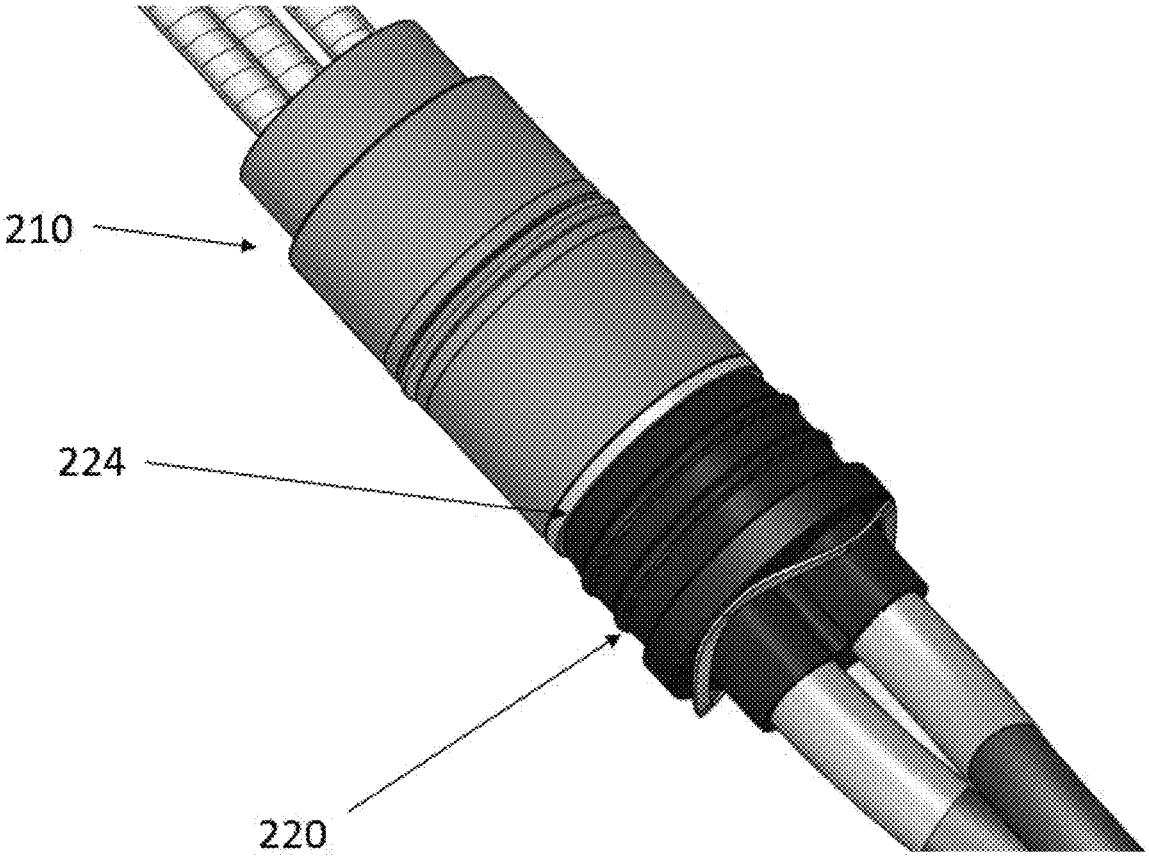
FIG. 5 depicts a perspective view of a combined upper penetrator assembly and lower penetrator assembly in accordance with various embodiments of the present disclosure.
Figure 6A:
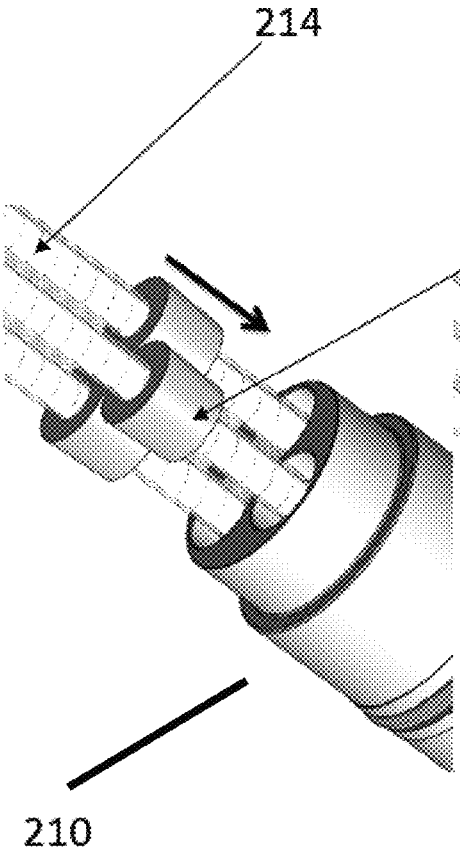
FIGS. 6A-B depict perspective views of an upper penetrator nose sealing element in accordance with various embodiments of the present disclosure.
Figure 6B:
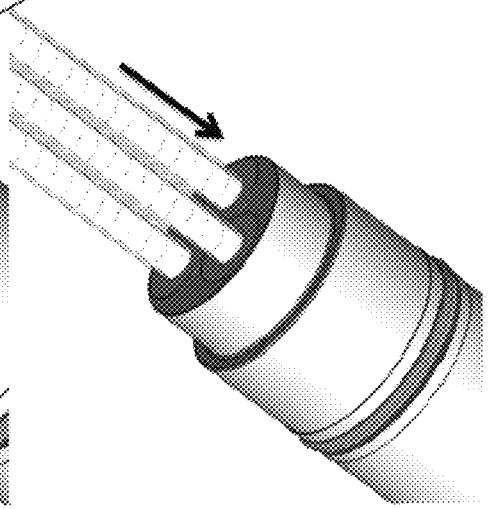

As an example, during a typical use, upper assembly 210 may be installed on three external power cables 214. First outer sealing element 217 is disposed on the exterior surface of upper body 211. Each external power cable 214 will be inserted through a nose sealing element 215 and into upper body 211 through to respective first female ends of each lug 212 as seen in FIG. 4. All three conductors from cables running from an ESP will be inserted through spring element 225 and primary lower sealing element 222. Primary lower sealing element 222 is configured with a receptable for each of the three conductors. Each conductor may then be passed through a respective secondary lower sealing element 223. Follower 224 may then be installed over the conductors that have been inserted through the secondary lower sealing elements. To combine upper assembly 210 and lower assembly 220, each conductor of the three ESP cables is inserted into a respective second female end of each lug 212 which are exposed beyond a lower face 218 of upper body 211. Each lug 212 has two set screws to secure the inserted conductor from an ESP cable. The two set screws may be tightened to secure each conductor. The torque applied to the set screws will dictate the amount of load that can be applied to the ESP cables before they are released from the lugs during a failure or other emergency event. Dielectric grease may be applied to secondary lower sealing elements 223, primary lower sealing element 222, and follower 224. While the base of primary lower sealing element 222 near spring element 225 is held, the upper assembly 210 may be slid toward lower assembly 220. This action will cause lugs 212 to be pushed upward and into upper body 211. Upper body 211 should come within 1.5 mm, or less, of follower 224. The upper assembly should be checked for damage and any foreign grease, dirt, or debris should be removed. Each nose sealing element 215 is then slid into upper body 211 until they are flush with an upper face 216 of upper body 211. The process of seating each nose sealing element 215 may be facilitated with the application of a small amount of dielectric grease to each nose sealing element 215. Dielectric grease is then applied to first outer sealing element 217 and the outer diameter of primary lower sealing element 222.

Figure 8:
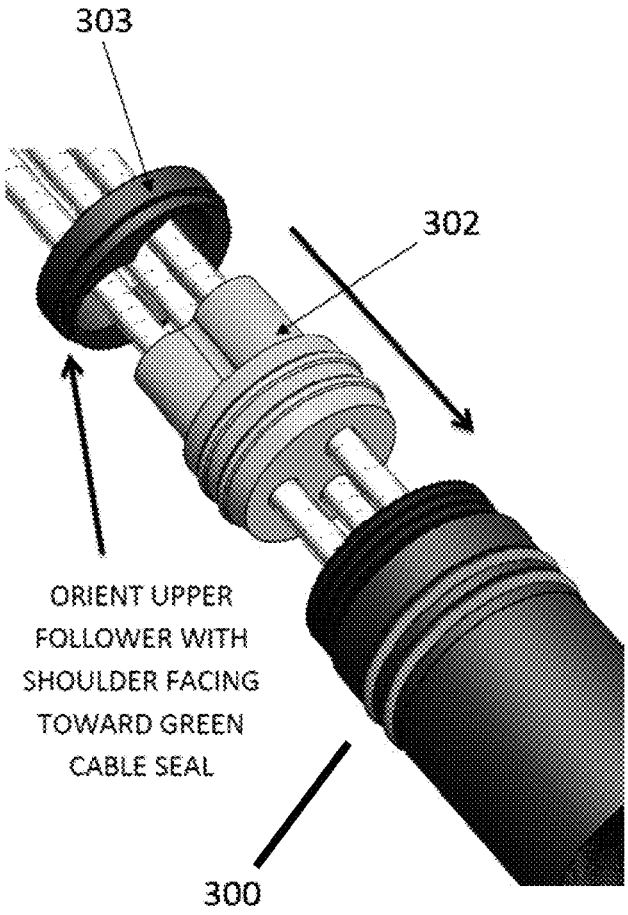
FIG. 8 depicts a perspective view of an upper penetrator cable sealing element in accordance with various embodiments of the present disclosure.
Figure 9:
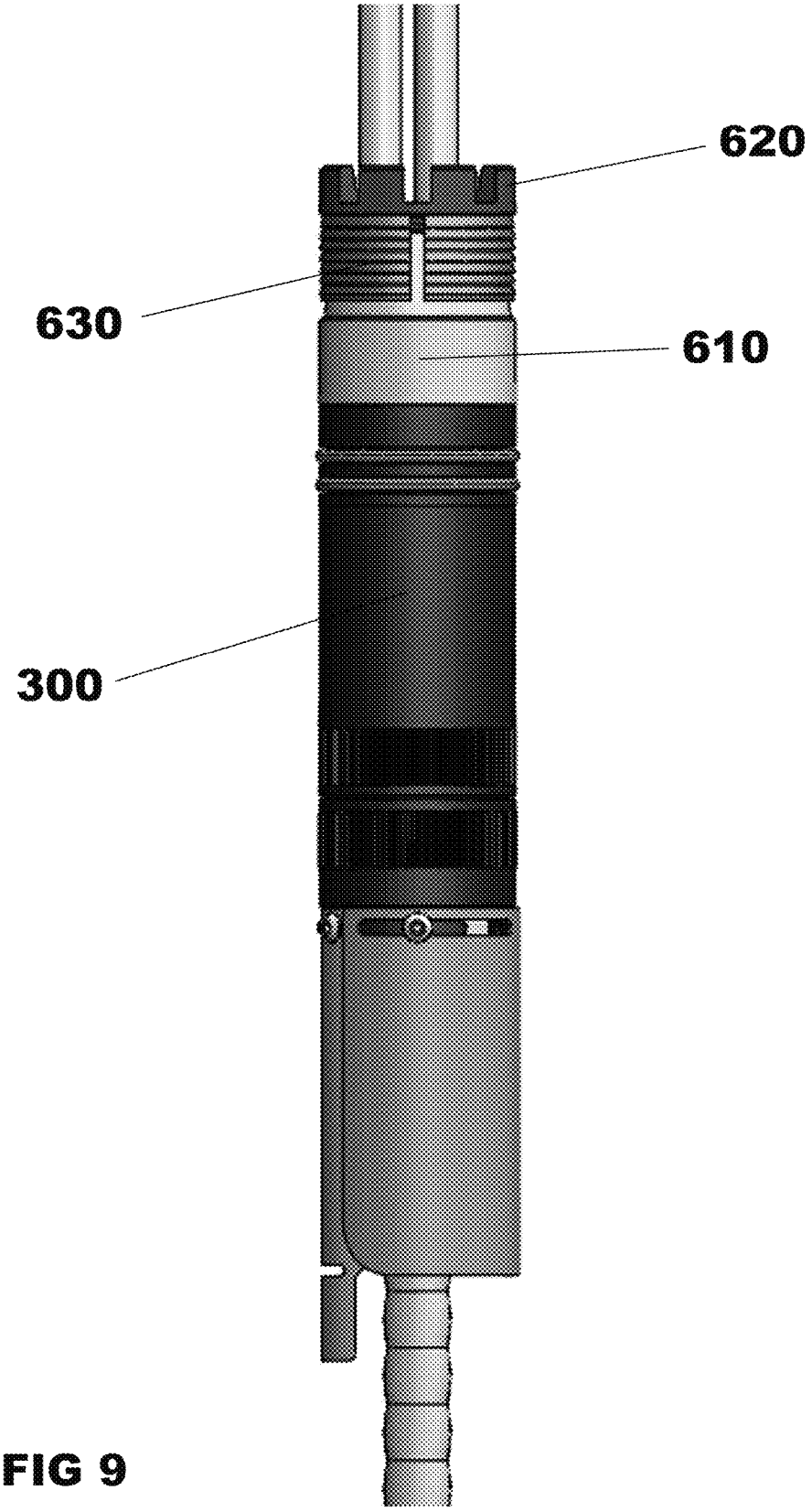
FIG. 9 depicts a side view of a penetrator assembly having an upper retention assembly in accordance with various embodiments of the present disclosure.

In further embodiments, penetrator assembly 200 may further include a penetrator housing element 300 and a lower penetrator cap 320. Penetrator housing element 300 may be configured with one or more outer grooves to receive at least one second outer sealing element 301. Penetrator housing element 300 may also be configured to at least partially contain upper assembly 210 and lower assembly 220. Penetrator housing element 300 may be configured with an upper threaded portion 304 and a lower threaded portion 305. Lower threaded portion 305 may be used to facilitate threaded engagement lower penetrator cap 320. These threaded portions may be positioned on the external surface of penetrator housing element 300. Lower penetrator cap 320 may be configured with a lower cap threaded portion 321 configured for engagement with lower threaded portion 305 of penetrator housing element 300. As shown in FIG. 8, penetrator assembly 200 may also include a primary upper sealing element 302 and upper sealing follower 303. Each conductor of an external power cable may be inserted into a corresponding aperture of upper sealing element 302.

Figure 7A:
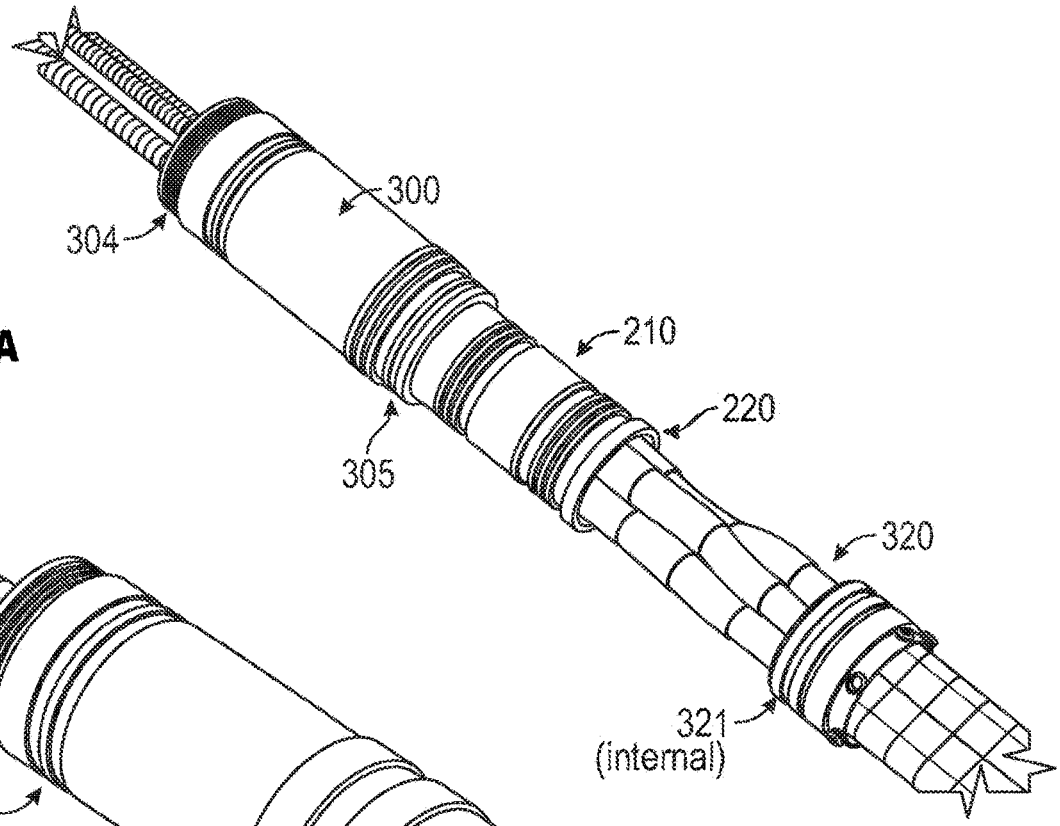
FIGS. 7A-B depict perspective views of a penetrator assembly housing element in accordance with various embodiments of the present disclosure.
Figure 7B:
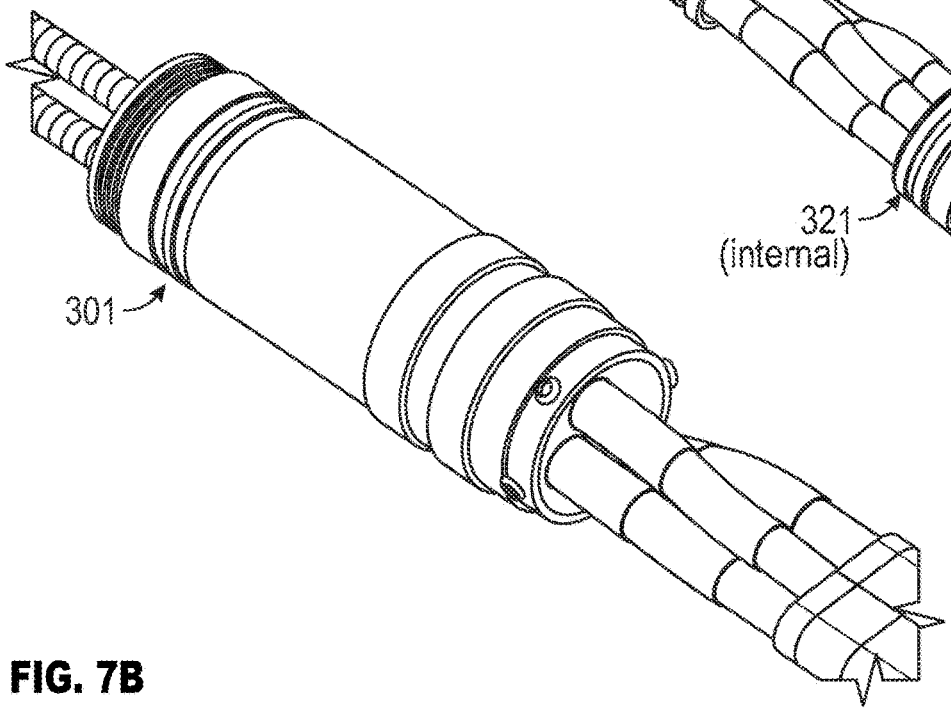

Returning to the exemplary use scenario set out above, the additional components of an embodiment of the present disclosure can be incorporated as follows. A penetrator housing element 300, which the external power cables may have been passed through before passing through upper assembly 210 and having two installed secondary outer sealing elements, may then be slid down and onto upper assembly 210. This can be achieved by holding primary lower sealing element 222 and sliding penetrator housing element 300 over upper assembly 210. Penetrator housing element 300 should continue to slide down until it substantially contains both upper assembly 210 and lower assembly 220. As depicted in FIGS. 7A-B, primary lower sealing element 222 may have ridges on its exterior surface. When installed over lower assembly 220, there should be minimal distance, if any, between the interior surface of penetrator housing element 300 and these ridges. These ridges will serve to minimize any potential fluid flow that may occur in a downhole failure. Lower penetrator cap 320, which the ESP cables may have been passed through before passing through lower assembly 220, may then be threaded onto lower threaded portion 305 of penetrator housing element 300. Shown in FIG. 8, upper sealing element 302 and upper sealing follower 303, which may also have had the external power cables passed through before including the penetrator housing element 300 and upper assembly 210, may then be installed into penetrator housing element 300. Upper sealing element 302 resembles primary lower sealing element 222 in structure but is oriented in the opposite direction. Dielectric grease may be applied to the outer diameter of upper sealing element 302. Upper sealing element 302 is slide down along the external power cables and into penetrator housing element 300 until it is flush against the upper face 216 of upper body 211. In such a position, the outer ridges depicted on upper sealing element 302 should be contained within penetrator housing element 300 with minimal, if any distance, between the interior surface of penetrator housing element 300 and the ridges. Upper sealing follower 303 is then slide downward and into penetrator housing element 300. Upper sealing following 303 may be configured with a shoulder such that, when installed into penetrator housing element 300, it is not fully inserted into penetrator housing element 300 but is rather supporting by an upper annular surface of penetrator housing 300 while leaving upper threaded portion 304 unobscured.

Although conductor retention elements 213 already provide for improved performance in the event of a tubing part or other downhole failure by allowing the ESP cables to disengage with the penetrator assembly at the bottom of the tubing hanger thereby preventing fluid and pressure from escaping into the wellhead, additional embodiments of the present disclosure, such as those shown in FIGS. 9-19, include a penetrator assembly 200 having an upper retention assembly 600 to enhance this performance and provide further safety benefits while relying only on the penetrator seal bore (often having a consistent diameter) wherein penetrator assembly 200 is disposed for the enhanced retention and security. Upper retention element 600 may include a retention connector 610, an upper retention cap 620, and an upper retention element 630.

Figure 12A:
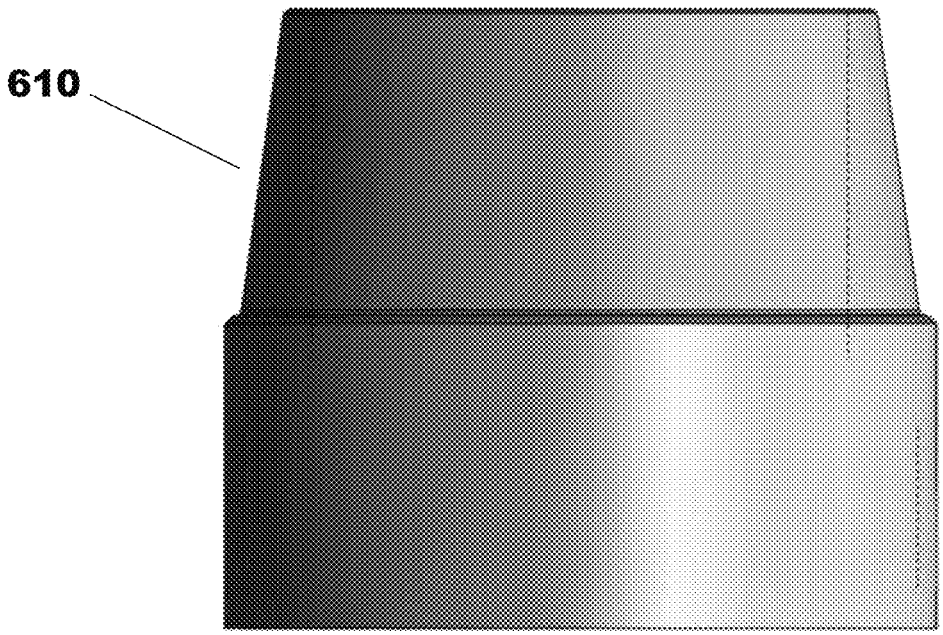
FIGS. 12A-C depict side, perspective, and cutaway side views of a retention connector in accordance with various embodiments of the present disclosure.
Figure 12B:
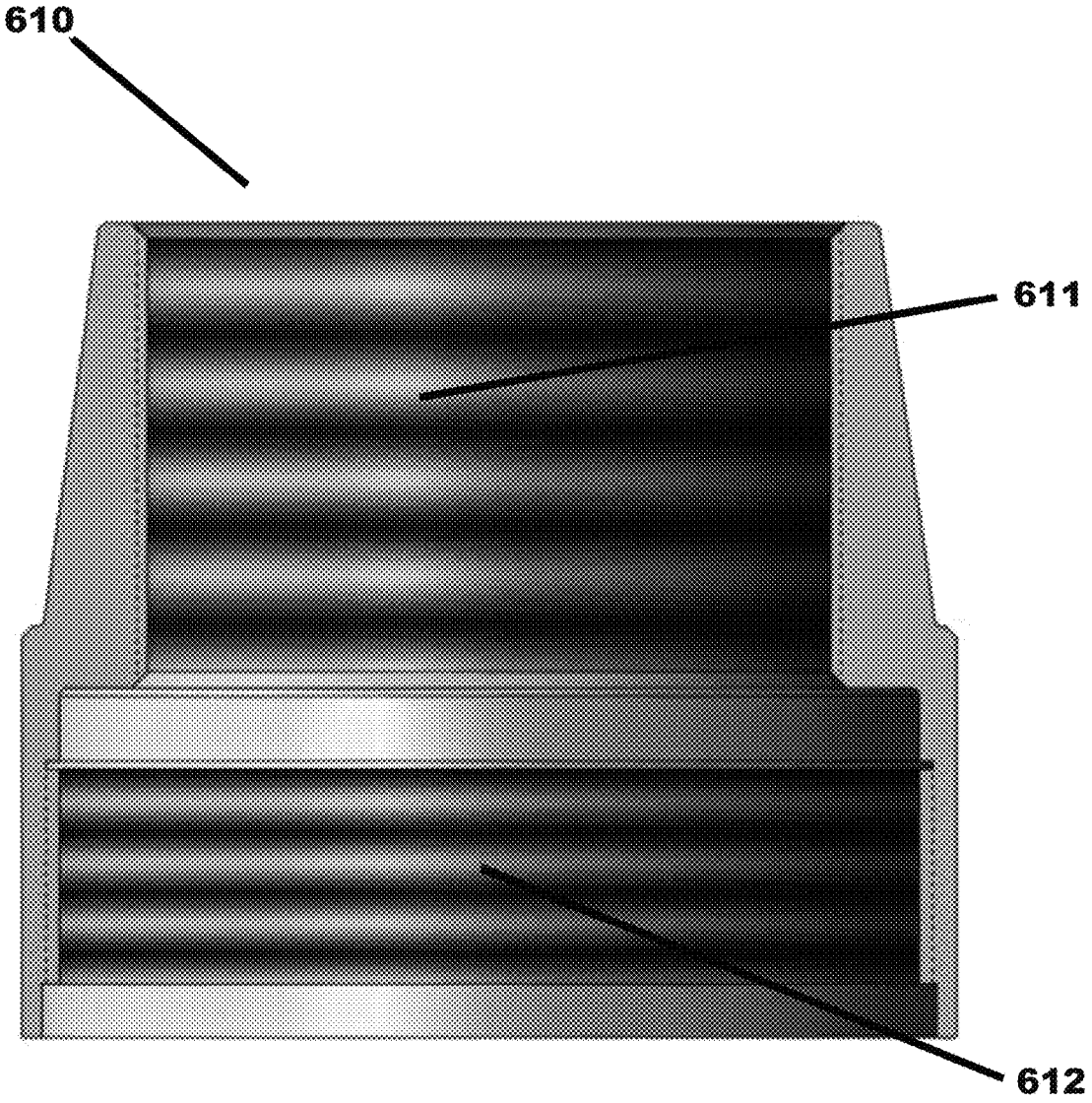
Figure 12C:
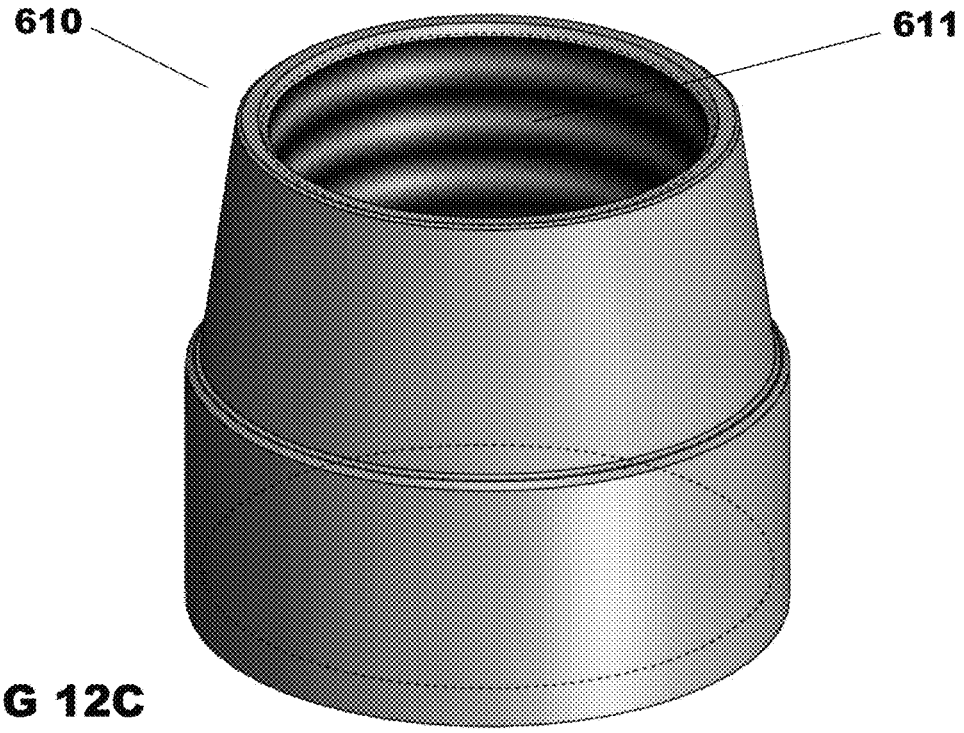

Depicted in FIGS. 12A-C, an exemplary retention connector 610 may have a top end, a bottom end, and a passageway formed between the two ends. Additionally, an internal set of upper connector threads 611 may be disposed near the top end. An internal set up of lower connector threads 612 may be disposed near the bottom end. The set of lower connector threads 612 may be configured for engagement with upper threaded portion 304 of penetrator housing element 300. The outer surface of retention connector 610 may taper radially inward towards the top end of retention connector 610.

Figure 11A:
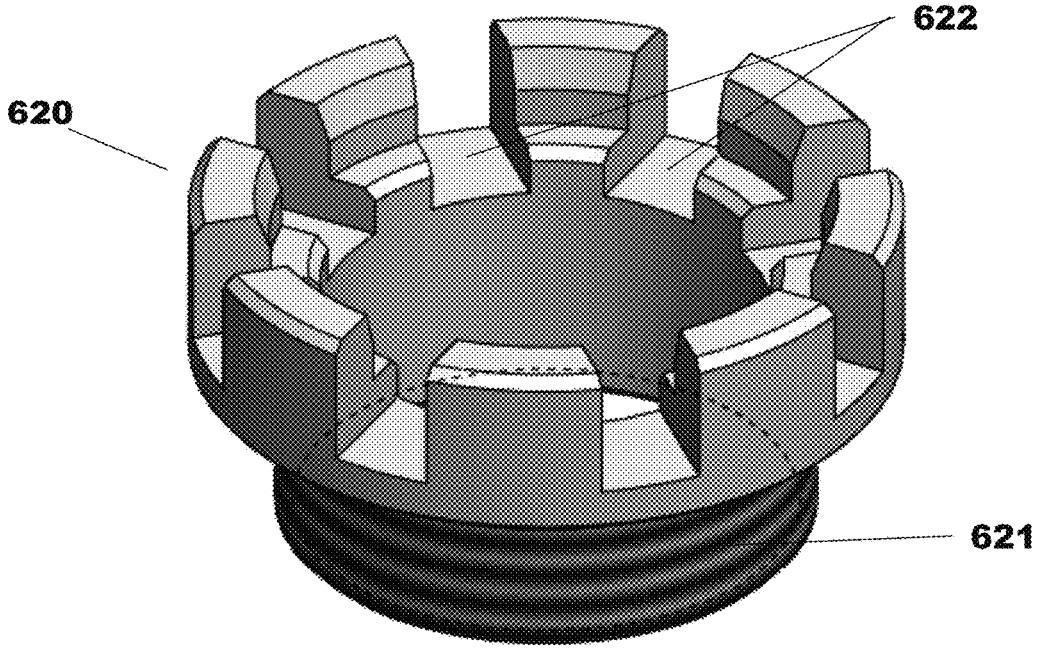
FIGS. 11A-C depict perspective views of an upper retention cap in accordance with various embodiments of the present invention.
Figure 11B:
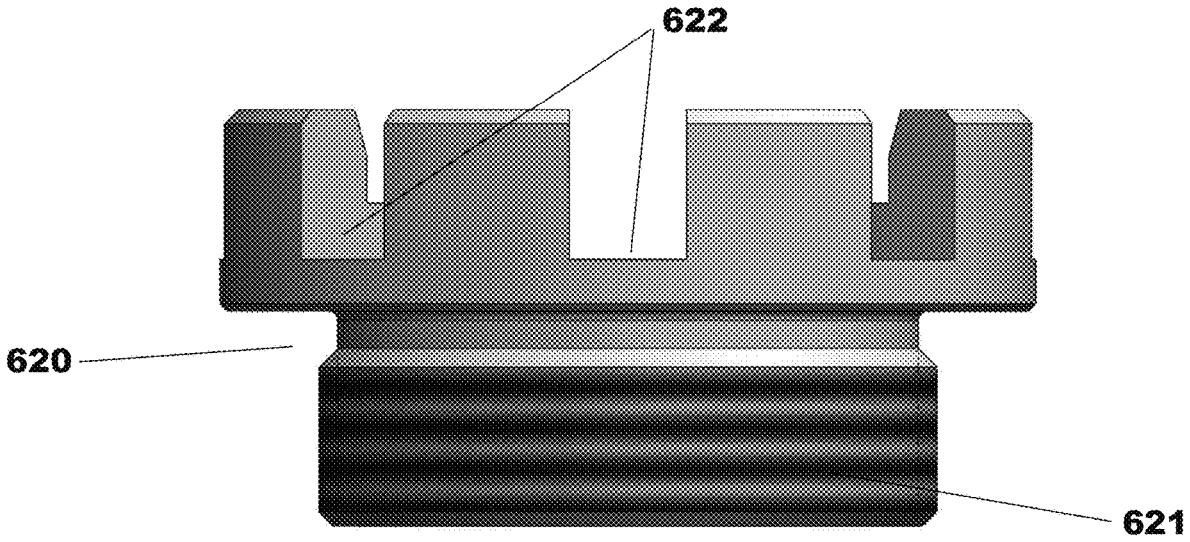
Figure 11C:
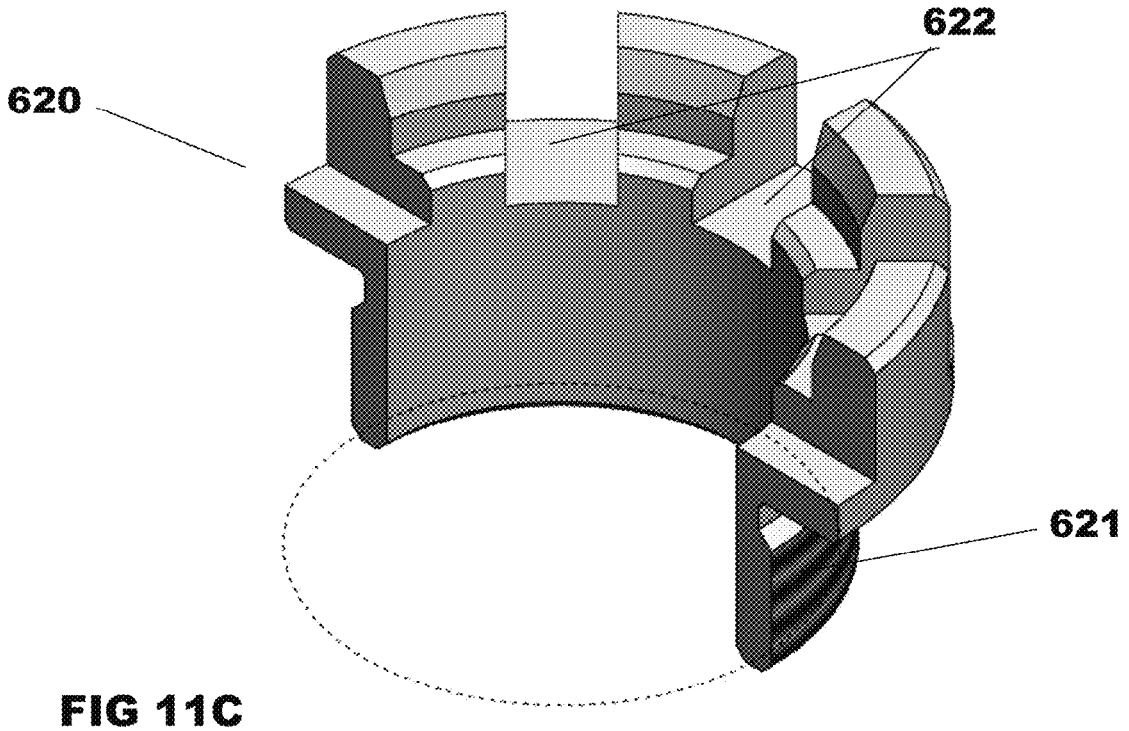

An exemplary upper retention cap 620, as shown in FIGS. 11A-C, may have an upper cap portion and lower cap portion with a passageway formed between the two portions. One or more actuation features 622 may be disposed along, or formed into, a top upper cap surface. The one or more actuation features may be one or more recesses, grooves, apertures, or other similar structures. A set of external cap threads 621 may be disposed along an outer surface of the lower cap portion. The set of external cap threads 621 may be configured to engage with the set of upper connector threads 611 of retention connector 620. The upper cap portion may have a diameter that is greater than that of the lower cap portion such that, when engaged to the exemplary retention connector 610, a recessed section is formed between the top upper cap surface of upper retention cap 620 and the bottom end of retention connector 610.

Figure 13A:
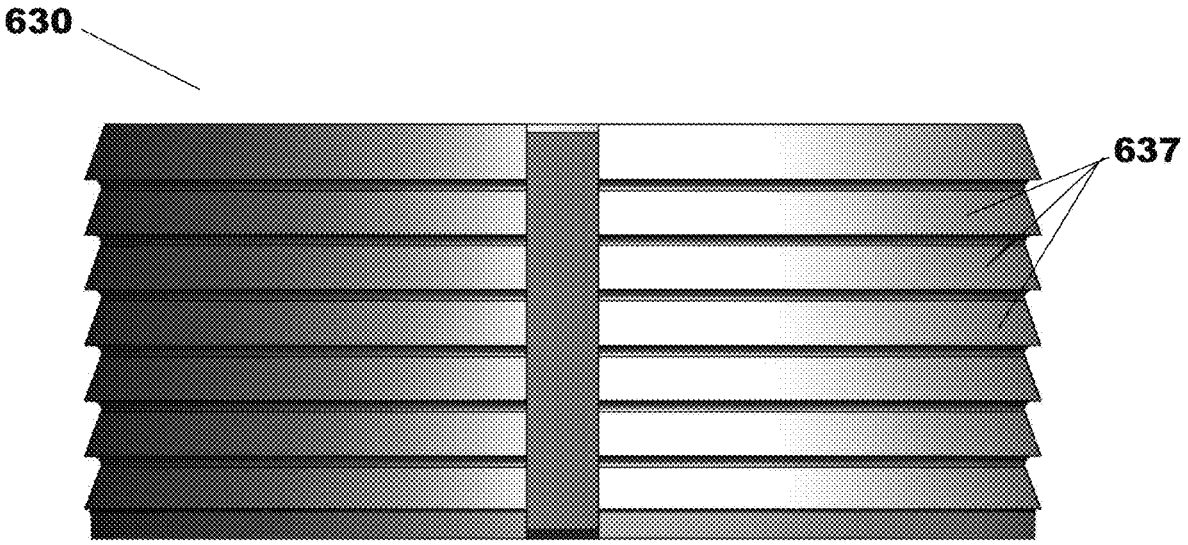
FIGS. 13A-C depicts a side, perspective, and cutaway side views of an upper retention element in accordance with various embodiments of the present disclosure.
Figure 13B:
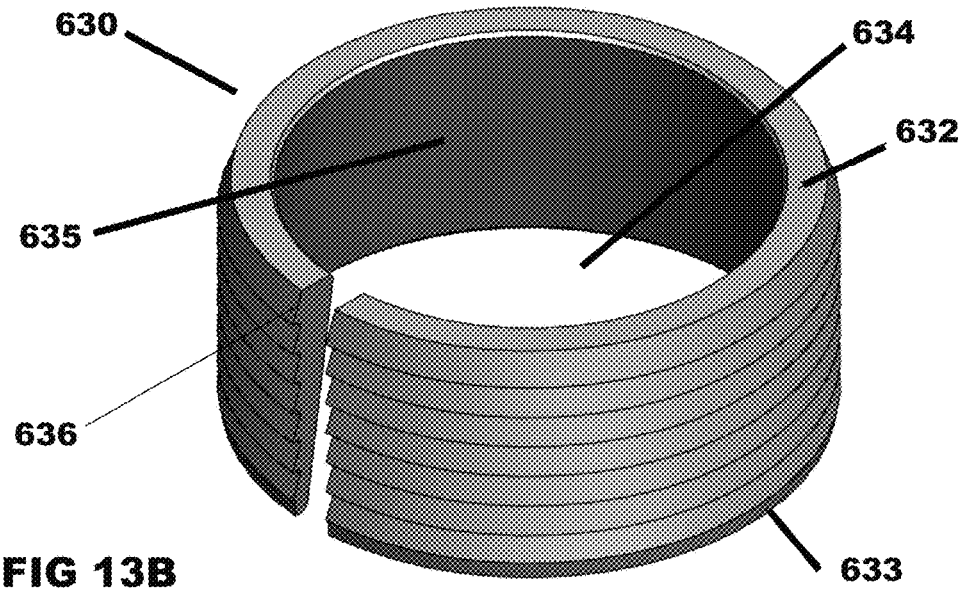
Figure 13C:
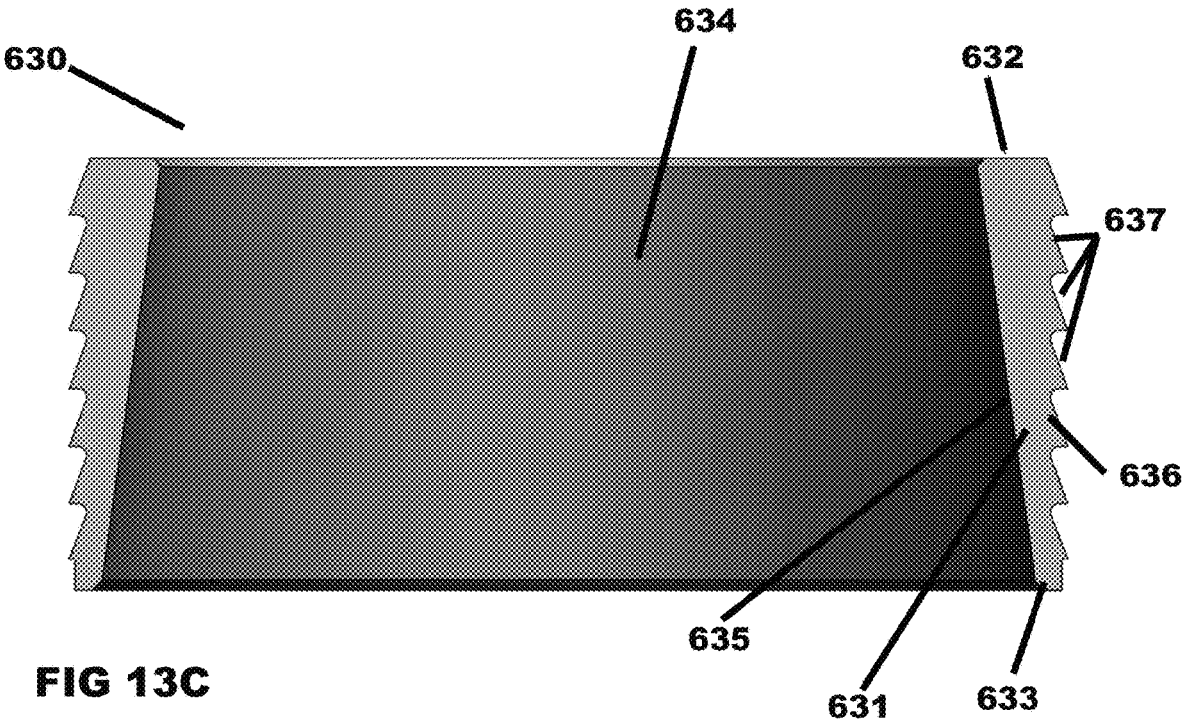

An exemplary upper retention element 630 is shown in FIGS. 13A-C. Upper retention element 630 may include a top surface 632 and a bottom surface 633 with a side wall 631 positioned therebetween. Top surface 632 and bottom surface 633 may be substantially annular in shape. Side wall 631 may define a passageway 634 that runs between top surface 632 and bottom surface 633. Additionally, side wall 631 may have an inner surface 635 and an outer surface 636. Inner surface 635 may taper radially inward as it moves from bottom surface 633 to top surface 632. Outer surface 636 may feature one or more retention features 637. One or more retention features 637 may be circumferential teeth, ridges, or other protrusions. Seen in FIGS. 9-10, upper retention element 630 may be configured for positioning between retention connector 610 and upper retention cap 620 in the recess formed between retention connector 610 and upper retention cap 620 when they are engaged to one another. Upper retention element 630 may be composed of low carbon steel (1018, 2020, 8620, etc.) that is carburized and heat treated to harden the surface. Upper retention element 630 may alternatively be formed other materials including a stainless steel base material such as 410 or 17-4.

Figure 10A:
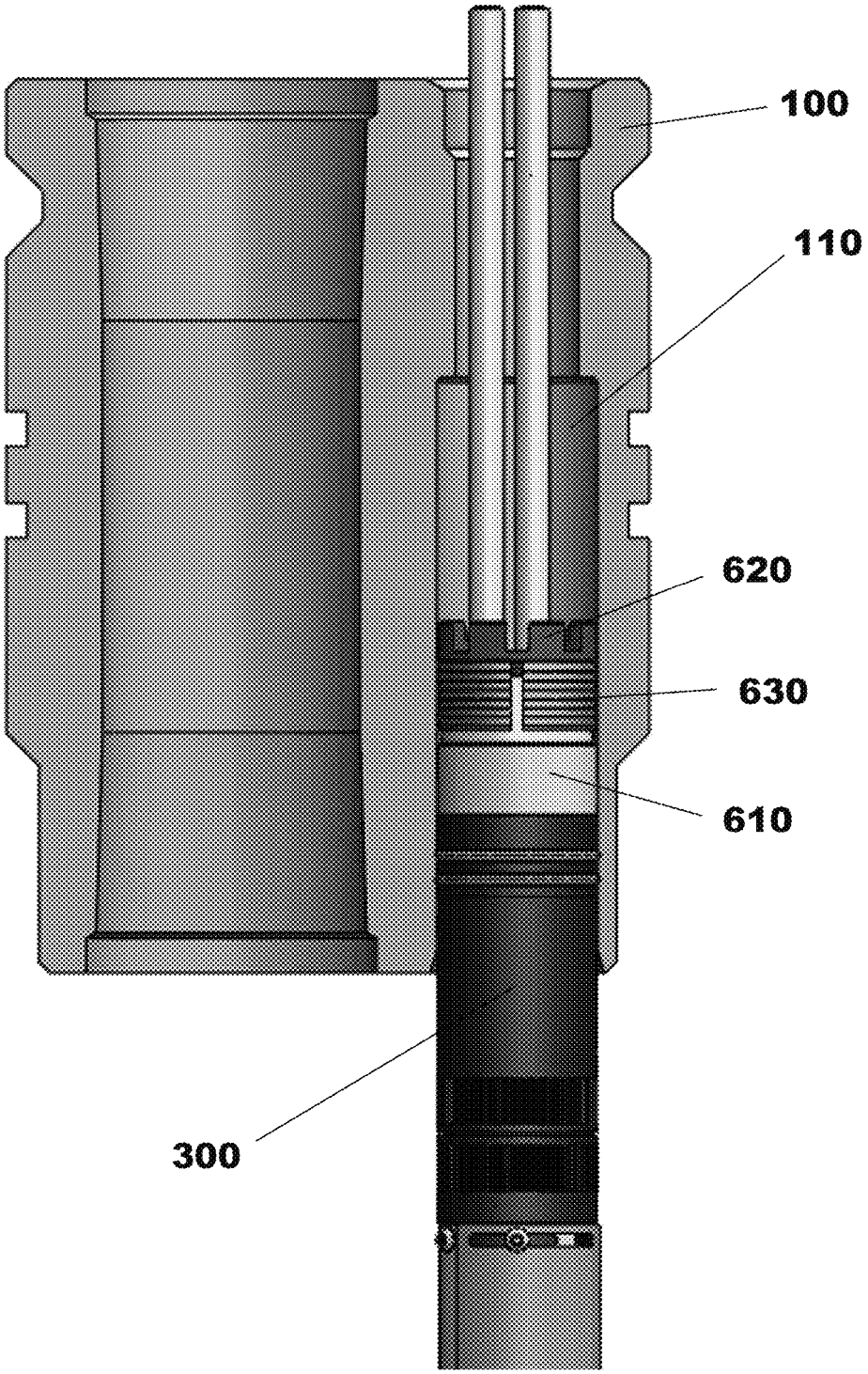
FIGS. 10A-B depict cutaway side views of a penetrator assembly having an upper retention assembly contained in a tubing hanger in accordance with various embodiments of the present disclosure.
Figure 10B:
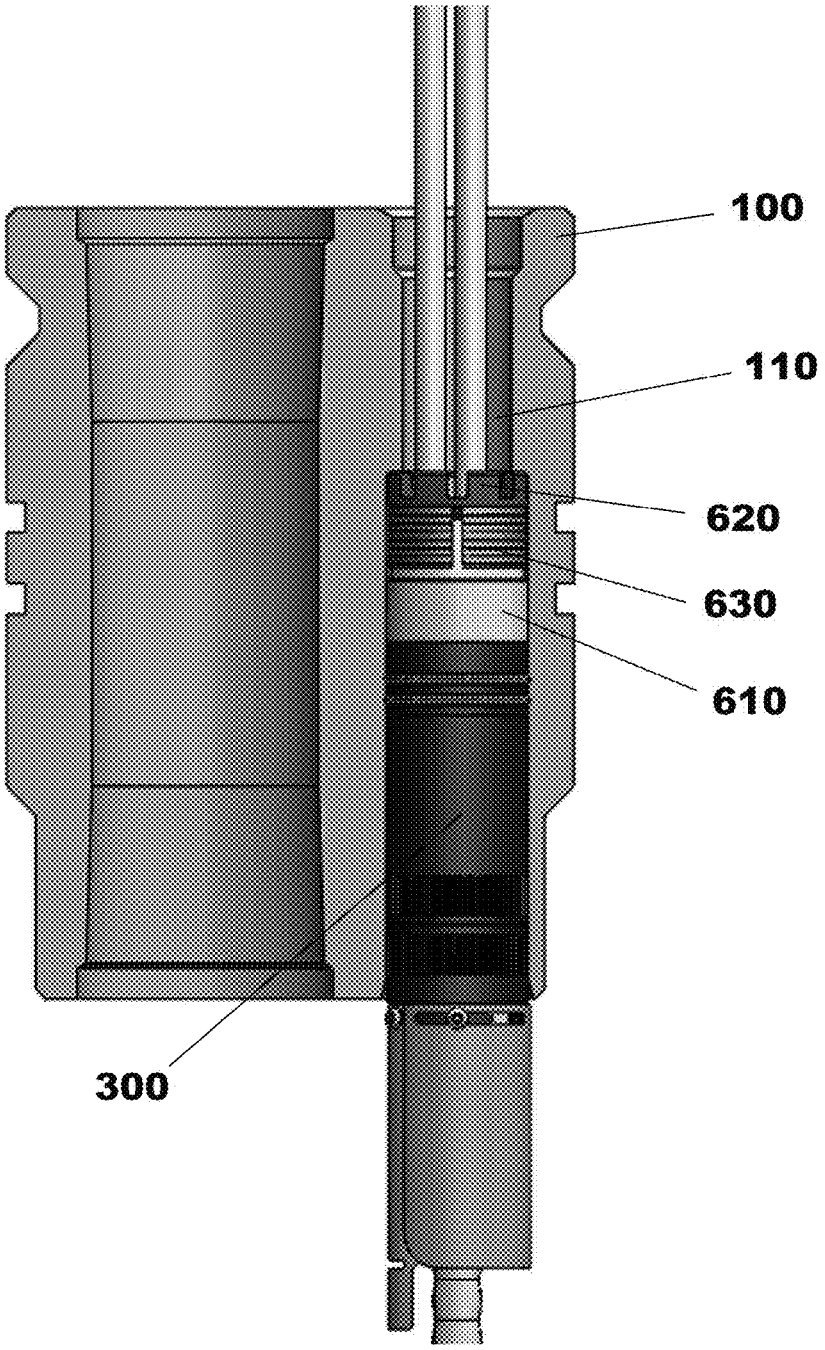
Figures 16A, 16B:
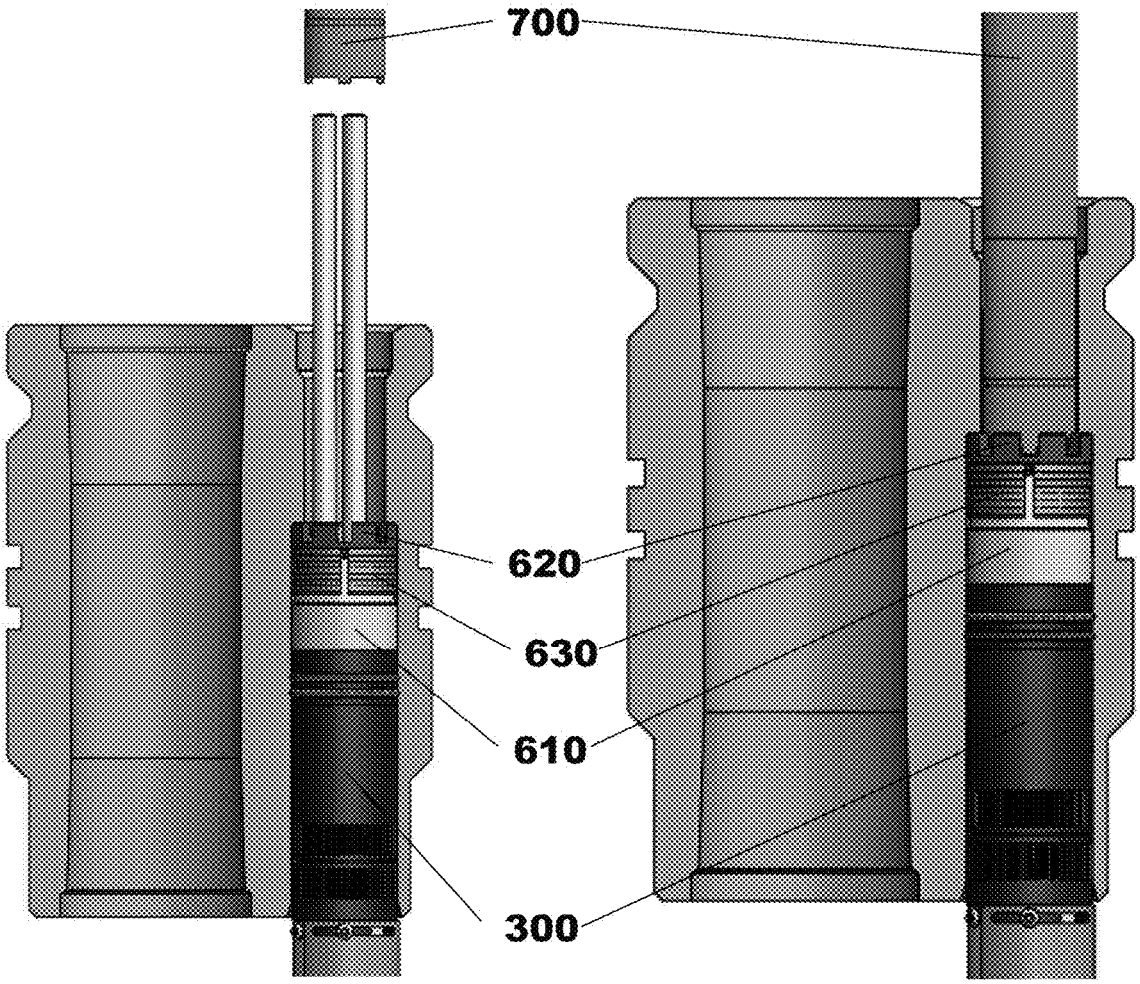
FIGS. 16A-B depict cutaway side views of a penetrator assembly having an upper retention assembly and actuation tool contained in a tubing hanger in accordance with various embodiments of the present disclosure.
Figure 17:
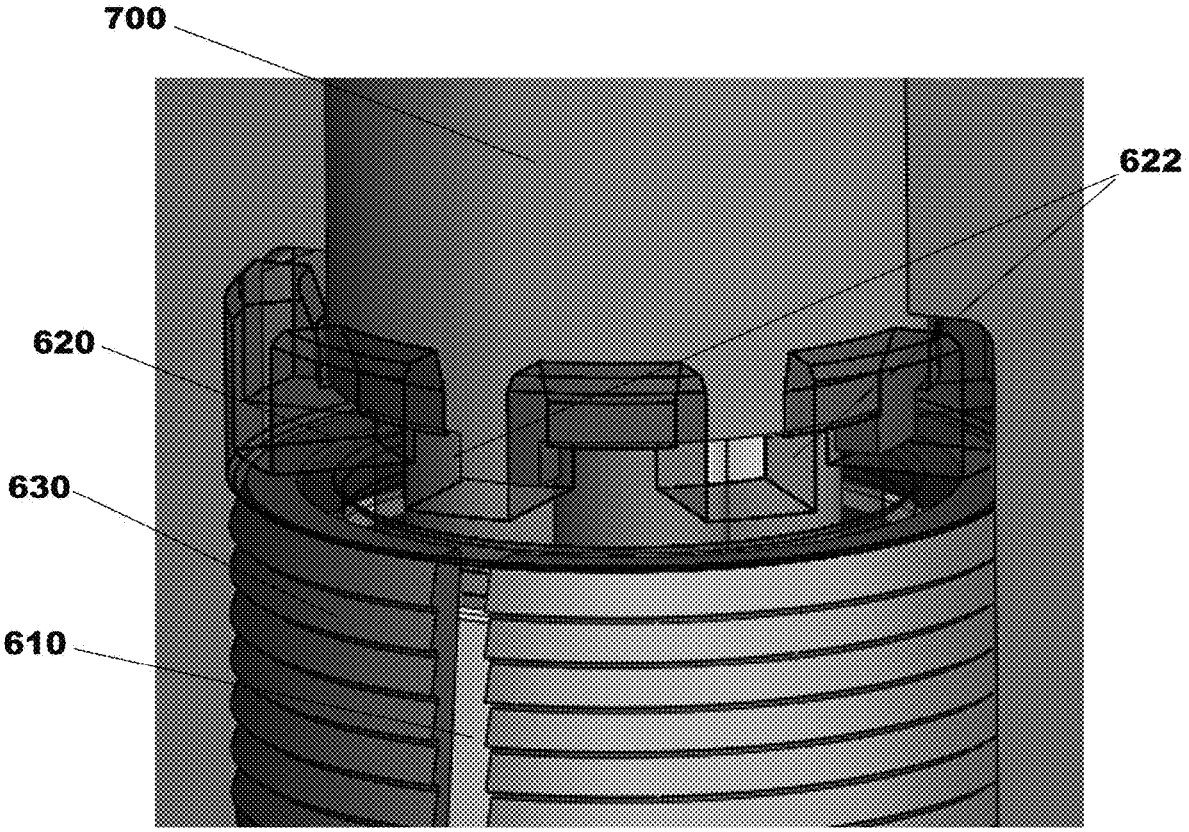
FIG. 17 depicts a perspective view of a penetrator assembly having an upper retention assembly and actuation tool contained in a tubing hanger in accordance with various embodiments of the present disclosure.

Returning again to the exemplary use scenario described previously, an embodiment of the present disclosure having a penetrator assembly 200 with an upper retention assembly 600 may be installed and used as depicted in FIGS. 9-10 and 16-19. The external power cables may be passed through the upper retention cap 620, upper retention element 630, and retention connector 610 before passing through penetrator housing element 300. The set of lower threads 612 of retention connector 610 may engage with the upper threaded portion 304 of housing element 300. Upper retention element 630 and upper retention cap 620 may be allowed to rest on top of retention connector 610 before the one or more retention features 637 are actuated. Alternatively, the set of external threads 621 of upper retention cap 620 may be engaged with the set of upper connector threads 611 of retention connector 610. Once penetrator assembly 200 is assembled, it can then be installed into the bottom of the feed-thru port within tubing hanger 100 until upper retention cap 620 shoulders out on an internal edge of tubing hanger 100 as depicted in FIG. 10. An actuation tool 700 may then be deployed into tubing hanger 100 as shown in FIGS. 16-18.

An exemplary actuation tool 700 can be seen in FIGS. 15A-C. Actuation tool 700 may have a first end 710 and a second end 720. The first end 710 may be configured for engagement with other tools such as a wrench. In some embodiments, a hex shape may be utilized at first end 710. Second end 720 may be configured for engagement with the one or more actuation features 622 of upper retention cap 620. In some embodiments, second end 720 may have castellated features, protrusions, ridges, or other geometries which correspond to, or may otherwise engage with, the one or more actuation features 622.

Figure 14:
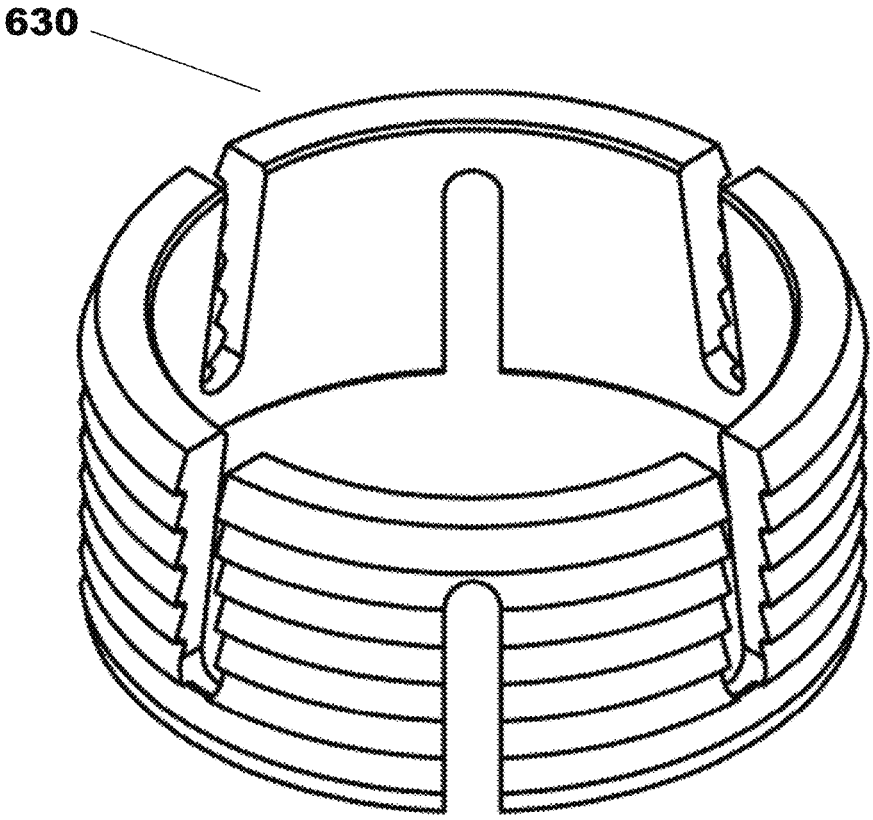
FIG. 14 depicts a perspective view of an upper retention element in accordance with various embodiments of the present disclosure.
Figure 18A:
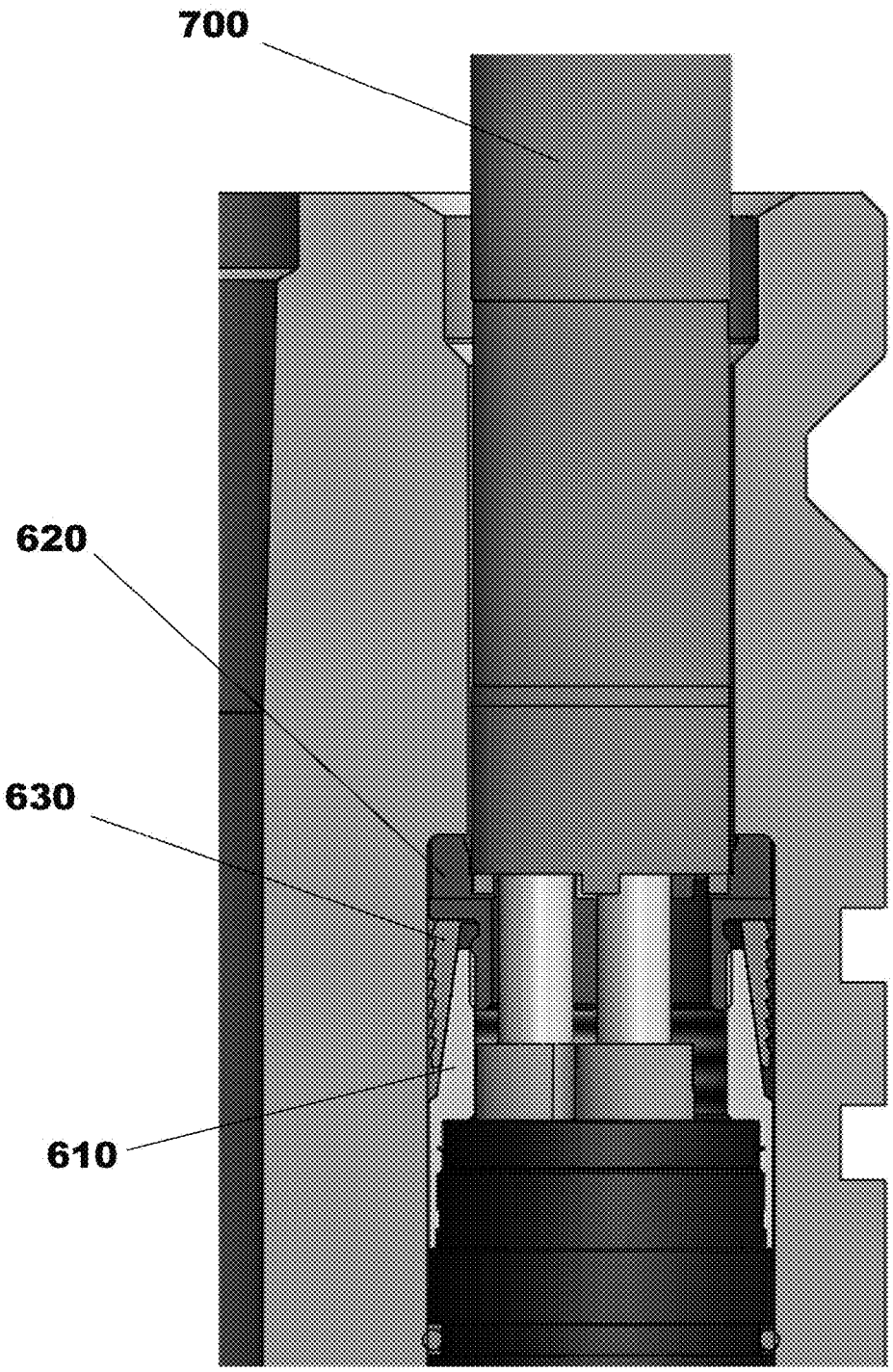
FIGS. 18A-C depict cutaway side views of a penetrator assembly having an upper retention assembly and actuation tool contained in a tubing hanger in accordance with various embodiments of the present disclosure.
Figure 18B:
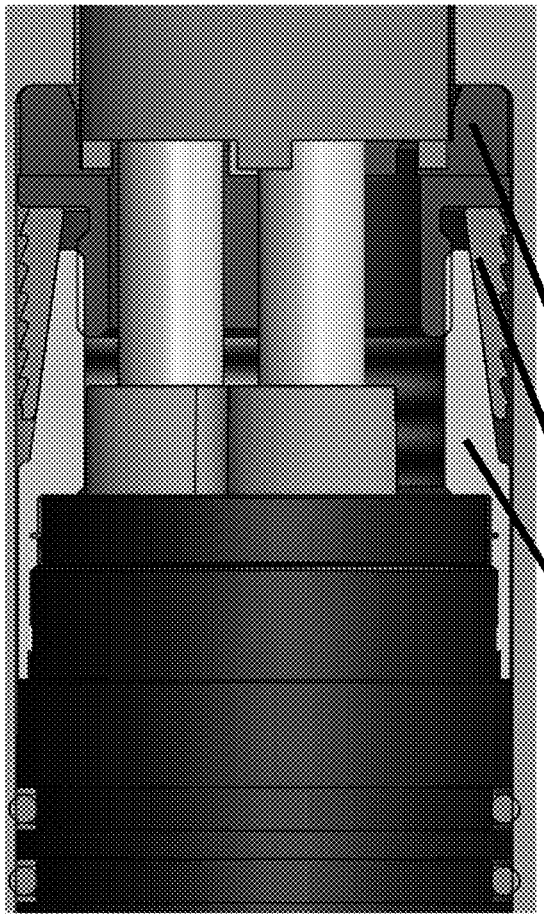
Figure 18C:
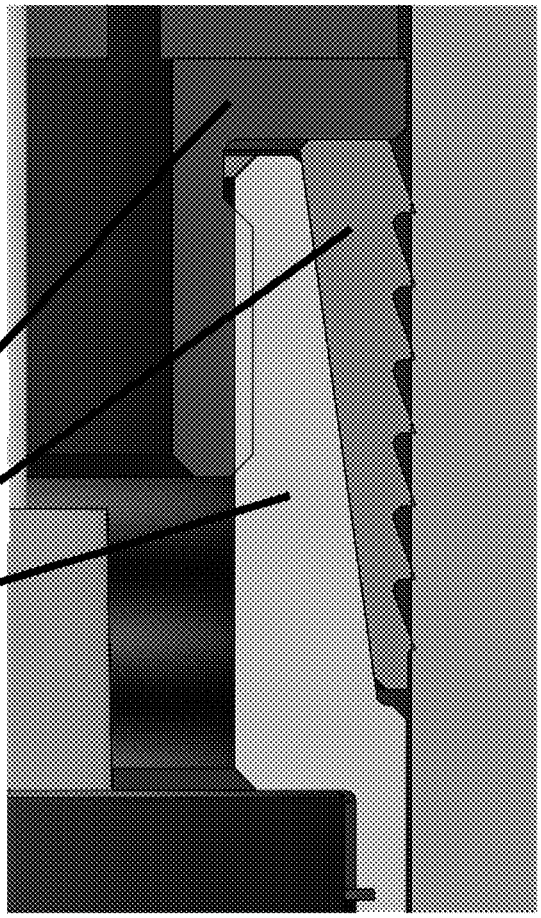

When deployed down tubing hanger 100, and as seen in FIG. 16, actuation tool 700 will be deployed with second end 720 entering tubing hanger 100 first. While penetrator assembly 200 is shouldered out, actuation tool 700 may be inserted further into tubing hanger 100 until it contacts upper retention cap 620. Shown in FIG. 17, actuation tool 700 may then engage upper retention cap 620 via the one or more actuation features 622. Shown in FIG. 18A, once engaged, actuation tool 700 may, with assistance of a tool engaged to the first end 710 of actuation tool 700, be rotated clockwise. This rotation will cause, as seen in FIGS. 18B-C, upper retention cap 620 to further engage with retention connector 610. This rotation will also cause engagement of upper retention cap 620 and upper retention element 630 thereby causing upper retention element 630 to be pushed downward along the tapered outer surface of retention connector 610. As it is pushed downward, due to the tapered outer surface of retention connector 610 and tapered inner surface of upper retention element 630, the outer surface 636 of upper retention element 630 will expand radially outward whereby the one or more retention features 637 may be put into contact with the inner surface of tubing hanger 100. To accommodate this expansion, upper retention element 630 may have one or more openings, slits, or recesses formed into its surface as seen in FIGS. 13B and 14. Once actuated by actuation tool 700, the one or more retention features 637 will provide secured retention of penetrator assembly 200 within the tubing hanger relying only on the penetrator seal bore as depicted in FIG. 19.

Figures 19A, 19B:
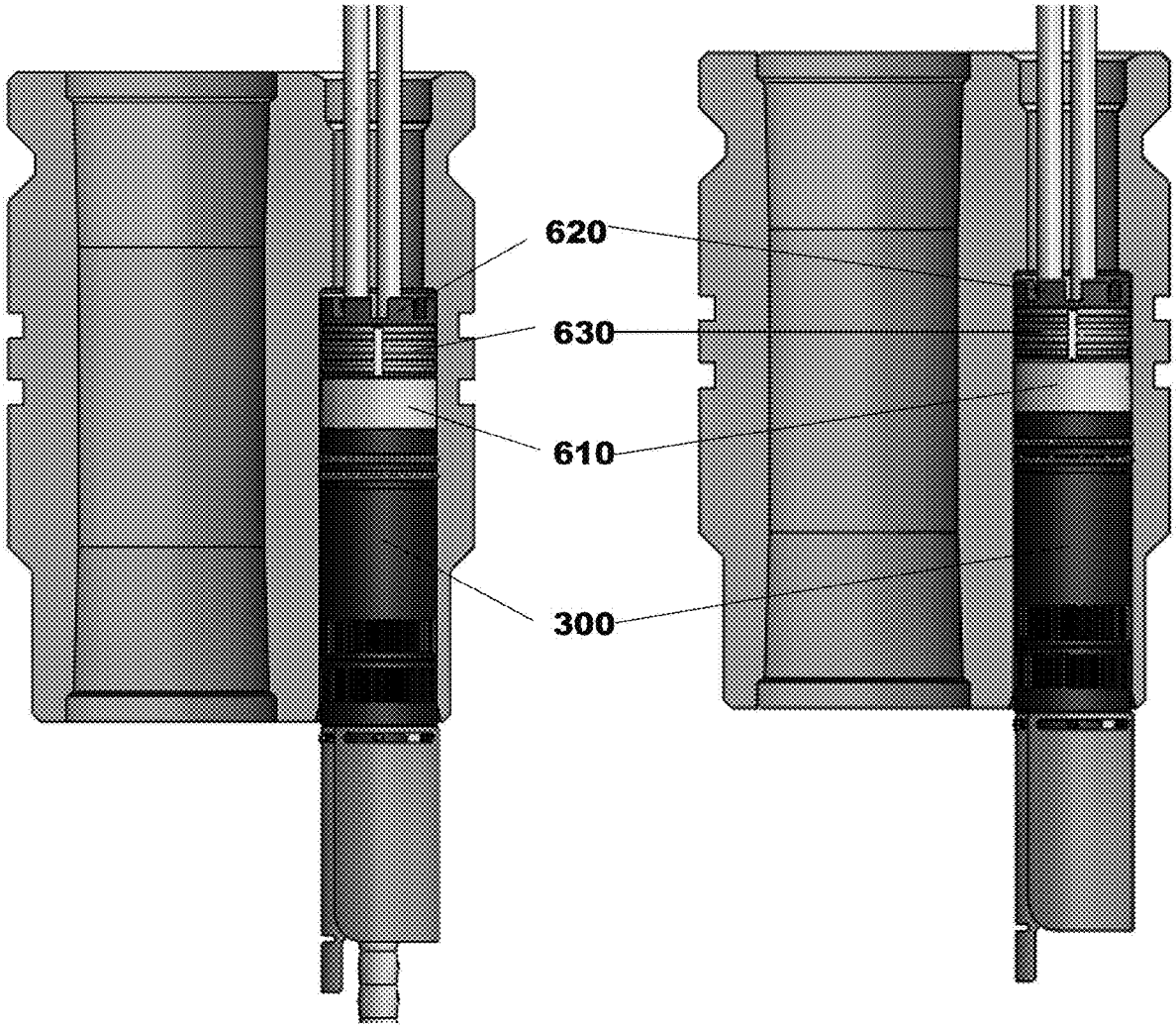
FIGS. 19A-B depict cutaway side views of a penetrator assembly having an upper retention assembly contained in a tubing hanger in accordance with various embodiments of the present disclosure.

As depicted in FIGS. 19A-B, in an event during which the ESP cables are broken away from penetrator assembly 200, the improved wellhead electrical connection assembly remains in place and the potential paths of fluid entry are blocked by the assembly's seals. As a result, there are no concerns of fluid exposure to workover personal as an adapter is removed (if applicable) and a blowout preventer (BOP) is installed because wellbore fluids are contained below the tubing hanger. Well control is maintained during these activities because of the sealing mechanisms set by penetrator assembly 200 and its upper retention assembly 600 within the tubing hanger.

The invention claimed is:

1. A wellhead electrical connector assembly comprising:

a substantially cylindrical outer housing body, said outer housing body being configured to substantially contain a first retention assembly, wherein said first retention assembly comprises:

a substantially cylindrical inner housing body:

at least one conductor receptacle, said at least one conductor receptacle being configured to engage with one or more cable conductors, said at least one conductor receptacle being further configured to securely engage with at least one of said one or more cable conductors;

an upper retention assembly configured to engage with a first end of said outer housing body, said upper retention assembly comprising:

a retention cap;

a retention connector configured for engagement with said outer housing body and said retention cap;

a retention feature configured to engage with a surface with which said retention feature makes contact;

wherein said retention connector comprises an upper threaded connector section and a lower threaded connector section, said lower threaded connector section being configured for engagement with said outer housing body; and wherein said retention cap comprises a cap threaded section configured for engagement with said upper threaded connector section, said retention cap further comprising at least one recess configured to receive a corresponding protrusion from an actuation tool.

2. The wellhead electrical connector assembly of claim 1 wherein said outer housing body has a first threaded outer housing section, wherein said retention connector has a first threaded connector section, said first threaded outer housing section and said first threaded connector section are configured for threaded engagement with one another.

3. The wellhead electrical connector assembly of claim 1 further comprising a lower assembly cap configured to engage with a second end of said outer housing body.

4. The wellhead electrical connector assembly of claim 3 further comprising a second retention assembly comprising a primary lower sealing element configured to couple to said one or more cable conductors, wherein said outer housing body is further configured to substantially contain said second retention assembly when said lower assembly cap is engaged to said second end of said outer housing body.

5. The wellhead electrical connector assembly of claim 1 wherein said at least one conductor receptacle comprises one or more conductor retention elements adapted to a reversible engagement between said at least one conductor receptacle and said one or more cable connectors.

6. The wellhead electrical connector assembly of claim 5 wherein said one or more conductor retention elements is at least one set screw.

7. The wellhead electrical connector assembly of claim 6 wherein said at least one set screw is flat-headed.

8. The wellhead connector assembly of claim 1 wherein said retention feature is disposed between said retention cap and said retention connector, wherein said retention feature is configured expand radially outward upon engagement by said retention cap.

9. The wellhead connector assembly of claim 8 wherein said retention feature comprises at least one circumferential ridge disposed along an outer retention feature surface of said retention feature.

* * * * *